US005916085A

United States Patent [19]

Wells

[11] Patent Number: 5,916,085

[45] Date of Patent: Jun. 29, 1999

[54] ROTATOR FOR ASSISTING A PERSON IN LYING DOWN ON AND GETTING UP FROM A BED AND METHOD OF USE

[76] Inventor: John R. Wells, 6569 Avenida Manana, La Jolla, Calif. 92037-6226

[21] Appl. No.: 08/747,230

[22] Filed: Nov. 12, 1996

[51] Int. Cl.[6] ..... A61G 7/053

[52] U.S. Cl. ..... 5/81.1 R; 5/608; 5/610

[58] Field of Search ..... 5/81.1 R, 83.1, 5/84.1, 85.1, 87.1, 89.1, 608, 610

[56] References Cited

U.S. PATENT DOCUMENTS

| | | | |
|---|---|---|---|
| 4,510,633 | 4/1985 | Thorne | 5/87.1 |
| 4,704,749 | 11/1987 | Aubert | 5/87.1 |
| 5,001,789 | 3/1991 | Schoenberger | 5/87.1 |
| 5,090,072 | 2/1992 | Gray | 5/87.1 |
| 5,283,917 | 2/1994 | Dietze | 5/83.1 |
| 5,323,498 | 6/1994 | Fellay et al. | 5/83.1 |
| 5,619,762 | 4/1997 | Mein | 5/83.1 |

*Primary Examiner*—Michael F. Trettel
*Assistant Examiner*—Fredrick Conley
*Attorney, Agent, or Firm*—Timothy T. Tyson

[57] ABSTRACT

A patient rotator (50) for assisting a patient having limited motion capabilities in lying down on a bed (500) and getting up to the side (502) and method of use are disclosed. The rotator has a frame (52) with a person support member (66) rotatably mounted on the frame at an axis (68) coplanar with the top (504) of the bed and perpendicular to the side. The patient uses a controller (94) to rotate himself on the person support member between vertical and horizontal orientations as desired while he remains on his side.

10 Claims, 15 Drawing Sheets

ROTATOR FOR ASSISTING A PERSON IN LYING DOWN ON AND GETTING UP FROM A BED AND METHOD OF USE

TECHNICAL FIELD

The present invention pertains to devices which assist ailing persons in translating between one body position and another, and in particular to an apparatus which assists a person in getting into and out of bed safely and without the aid of others.

BACKGROUND ART

The present invention relates to a patient rotator for assisting a person in lying down upon and arising from the top surface of a bed, and is particularly useful for patients who have undergone back surgery or other persons who have chronic back disorders. After back surgery patients are taught to get in and out of bed using a technique called "log rolling." To perform this movement the patient must hold his back straight during the process of getting in and out of bed. The patient starts the technique by sitting on the side of the bed. The patient then leans slowly to the right or left while holding the sitting posture until he is horizontal. The patient next extends his legs moving them onto the bed while keeping the back flat until his body is straight. The patient is now fully on the bed on his right or left side. The patient can roll to a supine position in a manner similar to rolling a log. When getting out of bed the process is reversed.

The above described movements are very difficult for a patient in pain from surgery, disease, or lack of activity. The most difficult action is the movement from the horizontal to vertical position while holding the sitting posture. This requires strong back, leg, and stomach muscles. In many cases this action is very painful, if not impossible, for the patient to perform properly. It is also very hard for a person who is weak, in pain, or has a neurological condition to sit on or stand from the side of the bed.

Devices for assisting a person in moving from one body position to another are old in the art. For example, U.S. Pat. No. 2,472,675 shows a side posture chiropractic adjusting table which translates a patient from a sitting position to a reclining position and visa versa. The table has a padded rotatable body rest and seat for rotating the patient from a vertical sitting position to a horizontal sitting position. U.S. Pat. No. 3,997,926 discloses a bed with an automatic tilting occupant support. The bed includes an open supportive framework pivotally mounting an occupant support platform for movement between horizontal and upright positions. The bed includes a drive mechanism and associated motor with controls to enable selective movement of the platform between the two positions. U.S. Pat. No. 4,016,005 depicts a method of transferring a person from a reclined position to a seated position. A sectionalized mattress is positioned in sequential steps so as to place the patient directly over a toilet without discomfort to the patient. The mattress together with the patient is positioned in a manner which allows the patient to use the toilet while sitting in an upright customary manner. U.S. Pat. No. 4,054,319 discloses an invalid wheelchair. The wheelchair is designed to enable an invalid to stand, sit, or choose at will any intermediate position to perform useful work and to move about in any position. The wheelchair consists of a unitary chassis and a body supporting fixed seat and fixed arm rests. The occupant is lifted out of the fixed seat by means of an elevating mechanism which includes a backrest, linkage system, and incorporated seat strap which raises the occupant to a normal standing position or lowers the occupant to a normal sitting position without the aid of others. U.S. Pat. No. 4,456,086 comprises an integrated wheelchair and ambulator. The ambulator, which can be mated to a wheeled frame to form a wheelchair, is provided to enable a paraplegic to stand on the ambulator and be separated from the frame for maneuvering in confined spaces. The ambulator has a power operated articulated linkage for raising the paraplegic out of and free of the frame to the standing position on the ambulator. U.S. Pat. No. 4,623,194 describes a body supporting device for a wheelchair for a handicapped person including a structure allowing an upright position. The device is comprised of two rigid segments, each mounted on the backrest by an articulated system which blocks the segment in a vertical orientation as armrest or horizontal orientation as thoracic half belt. A second set of means includes two cradle elements adapted to be immobilized in the same horizontal plane in alignment to form open leg guards fitting over the front of the subject's legs. U.S. Pat. No. 5,365,621 discloses an invalid lift to assist persons to stand or walk. The lift includes a supporting frame having a front portion extending in front of the person and a side portion on each side. There are wheels beneath the supporting frame to enable the lift to be manoeuvered. U.S. Pat. No. 5,535,459 includes a patient transfer seat for use in conjunction with a hospital bed to transfer a patient from the bed to another location. The transfer seat assembly has a frame portion and a removable seating portion.

None of the prior art devices provide a means for a patient to easily and safely get out and in an ordinary bed without pain.

DISCLOSURE OF INVENTION

The present invention is directed to a patient rotator which assists an ailing person in getting into and out of a bed or other horizontal surface without the aid or assistance of others, and to do so safely and with a minimum of pain. The patient rotator retains the person in a sitting posture as the person is rotated on his side between vertical and horizontal orientations, thereby allowing the person to stay relaxed and supported. The patient rotator supports the person at crucial points on his feet, ankles, legs, buttocks, torso, and shoulder so that there is both support and stability during the transition from vertical to horizontal positions and visa versa. Additionally, the positioning apparatus assists the person from a sitting position to a standing position through the use of a powered seat lift. The positioning apparatus further includes a plurality of handholds which may be grasped by the user. These assist the person in mounting and dismounting the patient rotator, as well as during the rotation process. The patient rotator also has adjustable components at critical points so that persons of different sizes can use the rotator safely and effectively.

In accordance with a preferred embodiment of the invention, a person support member is provided which is rotated around an axis substantially coplanar with the top surface of the bed. The patient rotator is placed adjacent either of the two sides of the bed with the rotation axis oriented substantially perpendicular to the side. The person support member is selectively rotatable between vertical and horizontal orientations.

To lie down on the bed, a person uses the handholds of the patient rotator to transition from a standing position to a seated position on the seat of the patient rotator which is positioned just above the top surface of the bed. The person then leans against the person support member. The person then rotates the foot support under his feet and moves his legs into contact with the leg support and his ankles into contact with the ankle support. The person then grasps the torso support handhold with one hand and the drive switch with the other in preparation for rotation of his body. When the drive switch is activated, the person support member rotates from vertical to horizontal while the person remains in a sitting posture rolling his buttocks on the seat which does not move. Once in the horizontal position, the person extends his legs and rolls off the patient rotator into a supine posture on the bed. To get up from the bed, the person reverses the procedure.

In accordance with an important aspect of the invention a pullover assembly is provided which includes a pullover bar and an attached strap. This feature is particularly useful in assisting a person in performing the rolling procedure to get from a supine posture to lying on his side in preparation for the horizontal to vertical rotation. The pullover assembly is rotated from a storage position to a substantially vertical position, thereby providing the person with a fixed object which can be pulled against to effect the transition from supine to side postures.

A unique aspect of the present invention is the interaction of the person with the apparatus. The patient rotator guides the person while getting onto and up from a horizontal surface in a manner that puts minimal strain on the torso while allowing the person to hold his back straight. This is particularly helpful for people who are suffering from conditions that make it difficult for them to get into or up from a bed.

The present invention resides by the side of the bed with the longer dimension of the person support member parallel to the bed. The patient rotator helps to stabilize the person as he sits and then supports the person from the side as the person is rotated down to the bed on his side. The foot support supports the feet and the legs and the torso support and torso support handhold assist the person in maintaining a sitting posture during the transition from vertical to horizontal with minimal strain and risk of falling.

It may be appreciated that while a preferred use of the present invention is to assist a person in getting into and out of a bed, the same positioning apparatus could be applied to accessing any horizontal surface such as an examining table, operating table, or gurney.

Another feature of the invention is that it is portable rather than being attached to the bed. It therefore allows a person to get on or off a bed from either side. It is also useful in a hospital where it can be moved from bed to bed to serve the needs of several patients.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 1:
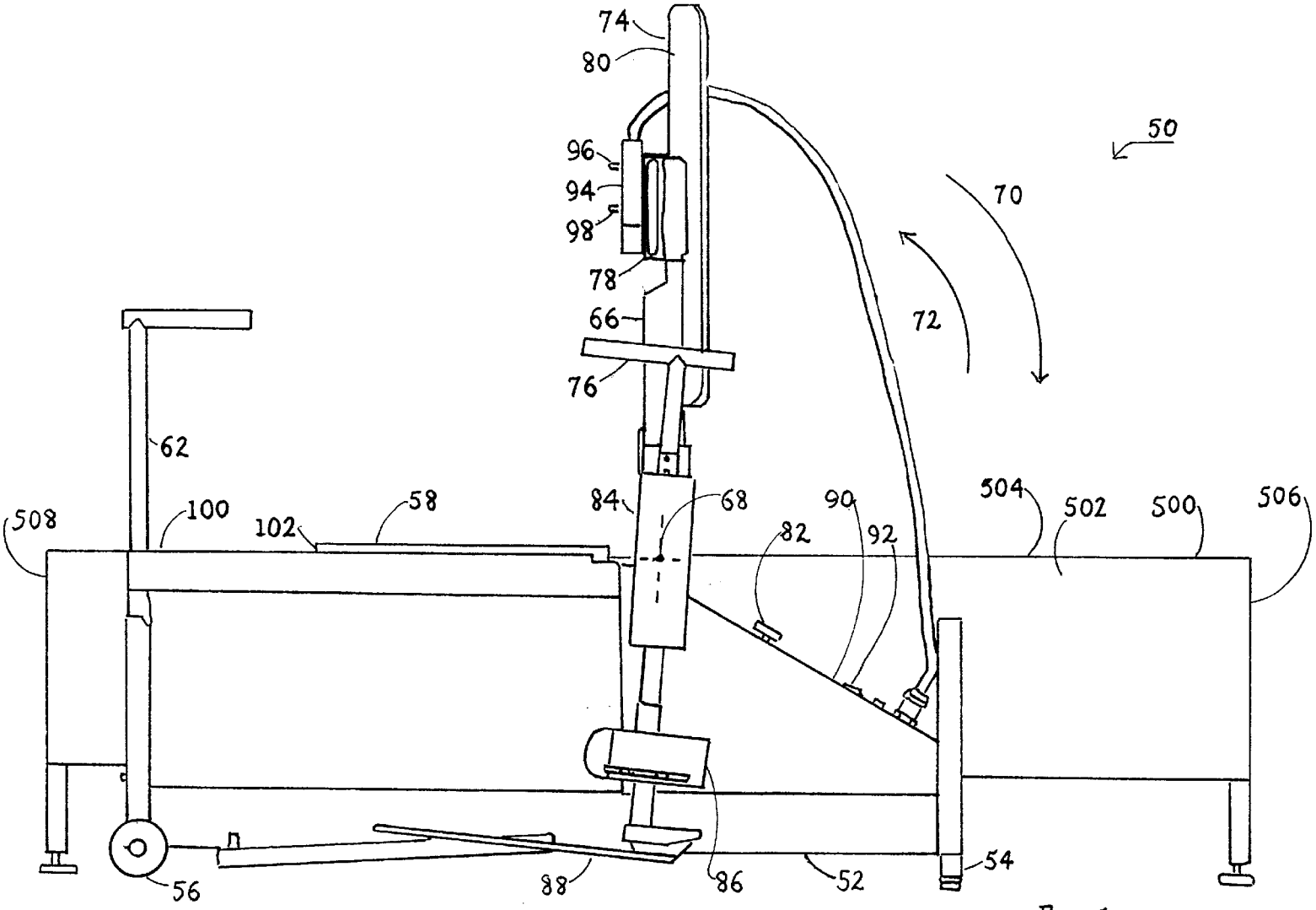
FIG. 1 is a front elevation view of a patient rotator in accordance with the present invention placed adjacent the side of a bed.
Figure 2:
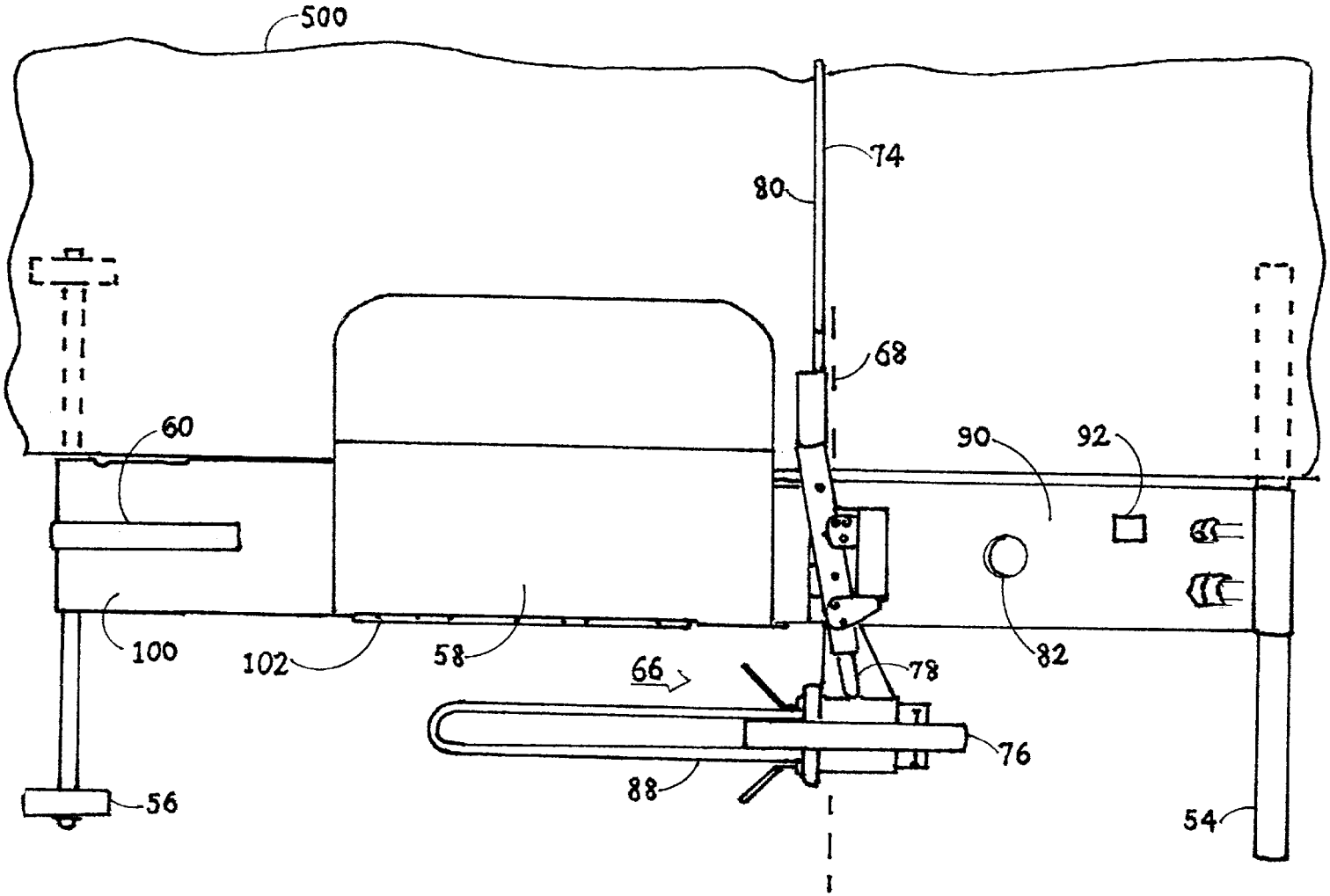
FIG. 2 is a top plan view of FIG. 1.
Figure 3:
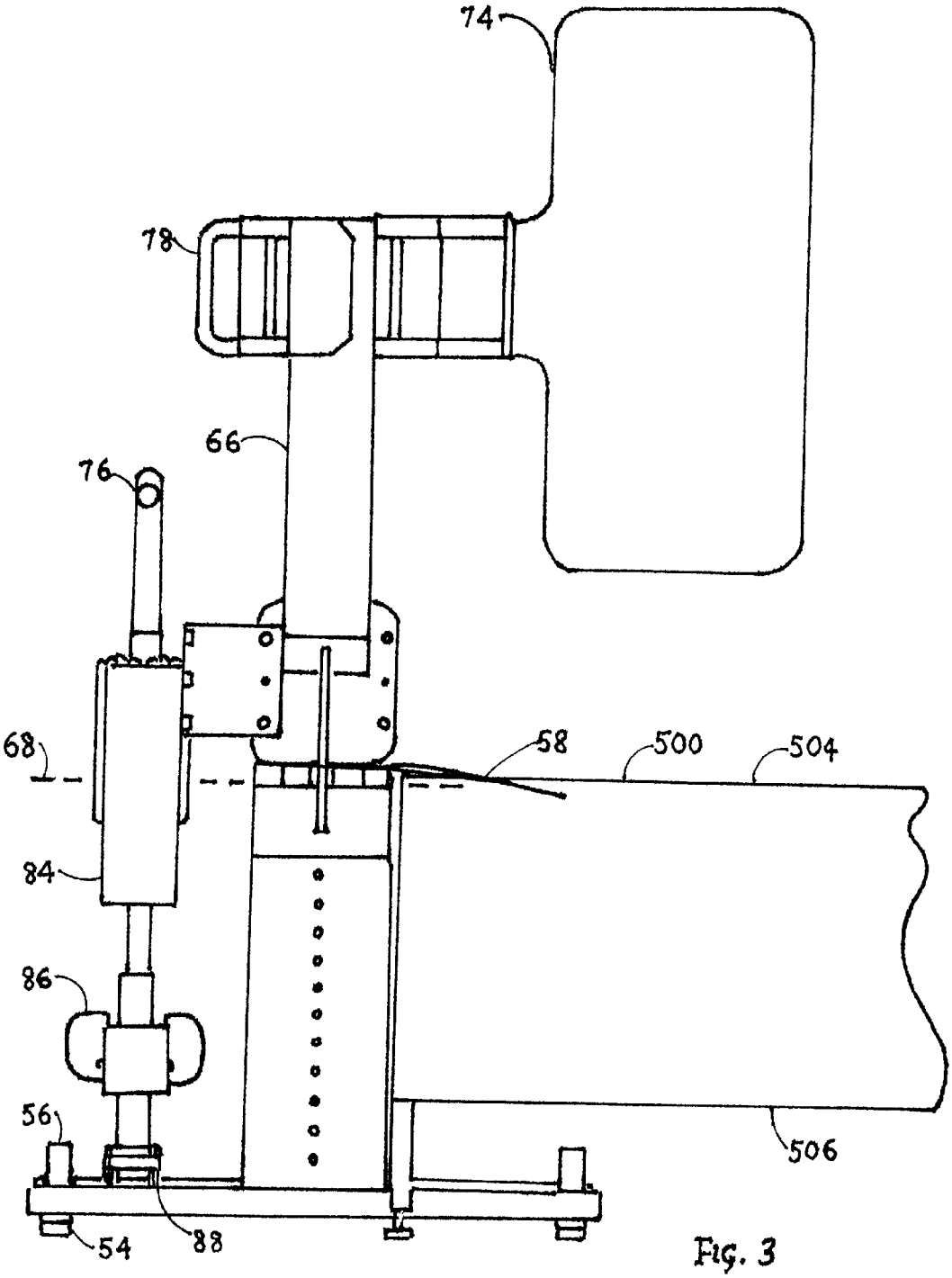
FIG. 3 is a right end elevation view of FIG. 1.

Referring initially to FIGS. 1, 2, and 3, there are illustrated front elevation, top plan, and right end elevation views of a patient rotator for assisting a person in lying down upon and arising from a bed or other horizontal surface in accordance with the present invention, generally designated 50. Patient rotator 50 includes a frame 52 having height adjustable legs 54 and wheels 56 which determine the vertical position of attached seat 58. Patient rotator 50 is placed so as to abut one of the two sides 502 of a bed 500 having an upwardly facing horizontal surface 504, a head 506, and a foot 508. Patient rotator 50 further includes a fixed handhold 60 having a vertically extending portion 62 and a horizontally extending portion 64 which is suitable for grasping by the hand in a pistol grip fashion. A person support member 66 for supporting a person is rotatably coupled to frame 52 about an axis 68. In the ready for use position of the patient rotator, legs 54 and wheels 56 are vertically adjusted and horizontally positioned so that axis 68 is both substantially coplaner with the horizontal surface 504 of the top of the bed and substantially perpendicular to abutting side 502 of bed 500. Person support member 66 is selectively rotatable around axis 68 between a substantially vertical orientation shown in FIG. 1 and a substantially horizontal orientation along surface 504. Person support member 66 rotates in direction 70 when moving from a vertical orientation to a horizontal orientation, and in direction 72 when moving from a horizontal orientation to a vertical orientation. Person support member 66 further includes a torso support 74 and two handholds, moving handhold 76 for use with fixed handhold 60 to sit down or get up, and torso support handhold 78 for use when the person support member is being rotated. Torso support 74 has a flattened surface 80 suitable for supporting the shoulder and side upper body of the user. Flattened surface 80 is substantially parallel to axis of rotation 68.

The patient rotator 50 is adjusted to a particular person by having the person stand adjacent the person support member 66. The fixed and moving handholds 60, 76 are adjusted vertically to be comfortably reached by the person. The torso support 74 is then adjusted vertically and horizontally to match the person. The vertical angle of the person support member 66 is also adjustable, if desired, to slightly off vertical using vertical adjustment knob 82.

Leg support 84 and ankle support 86 are attached to person support member 66 and oriented so as to receive the outerside of the user's leg and ankle. Foot support 88 is positioned under and supports the user's feet. The foot support may be adjusted vertically to the most comfortable position for the user.

Figure 15:
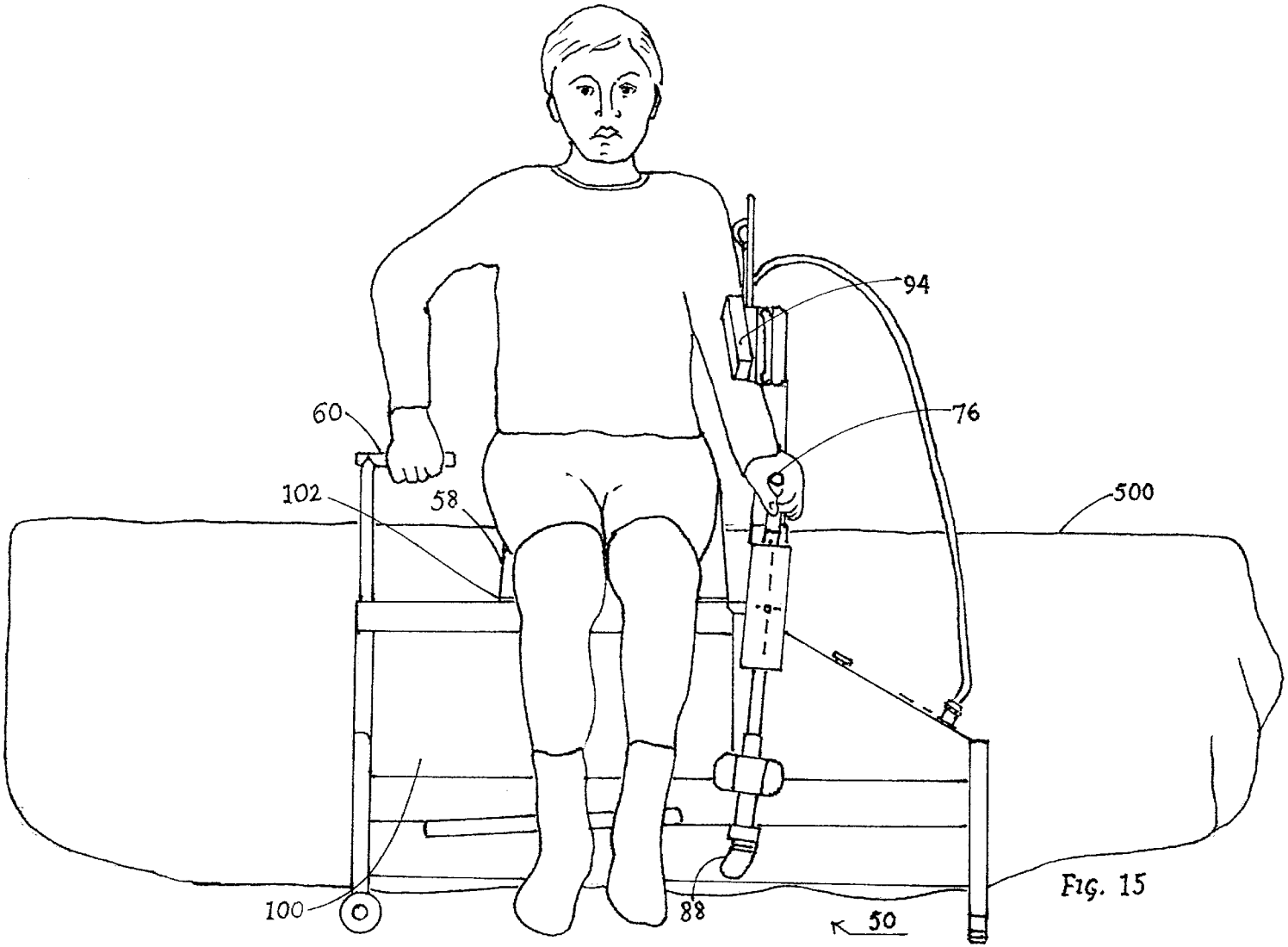

A rotating means inside control cabinet 90 causes person support member 66 to selectively rotate around axis 68 from a vertical orientation to a horizontal orientation and visa versa as shown in the subsequent figures. Various types of rotating means may be utilized so long as they are of sufficient capacity to reliably lower and raise the person support member along with a person. An electric motor with a worm gear is a preferred embodiment. Hydraulic means could also be employed. The time to transition from vertical to horizontal or visa versa can be varied. It is noted, however, that too rapid or too long a transition could cause discomfort to the user. A transition time of 15 seconds has been found useful. A power switch 92 and a hand actuated controller 94 selectively control the operation of the rotating member 66. The controller 94 includes two spring loaded to off position switches 96 and 98, one for moving the person support member 66 from vertical to horizontal in the direction of arrow 70 and one for moving the person support member from horizontal to vertical in the direction of arrow 72. The controller also controls a seat lifting means inside seat cabinet 100 which causes seat 58 to selectively rotate along a hinge 102 pushing up the user from the rear until the back of the seat reaches a 450 angle from horizontal as shown in FIG. 15. Other seat lifting arrangments could also be used which lift the person directly up.

Figure 4:
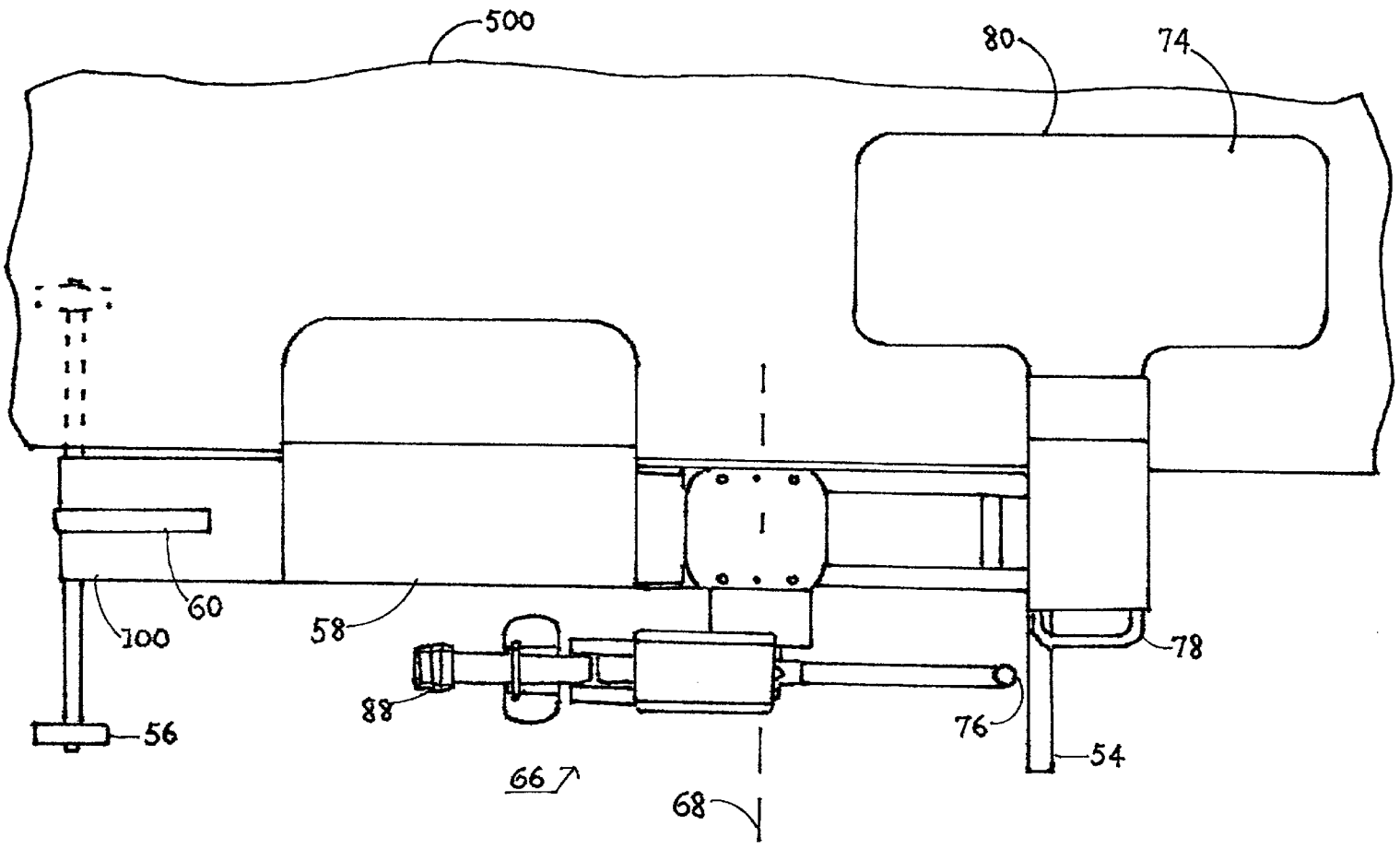
FIG. 4 is a top plan view similar to FIG. 2 with the person support member down placing the torso support on the bed.

FIG. 4 is a top plan view similar to FIG. 2 with the person support member 66 down placing the torso support 74 on the bed 500.

Figure 5:
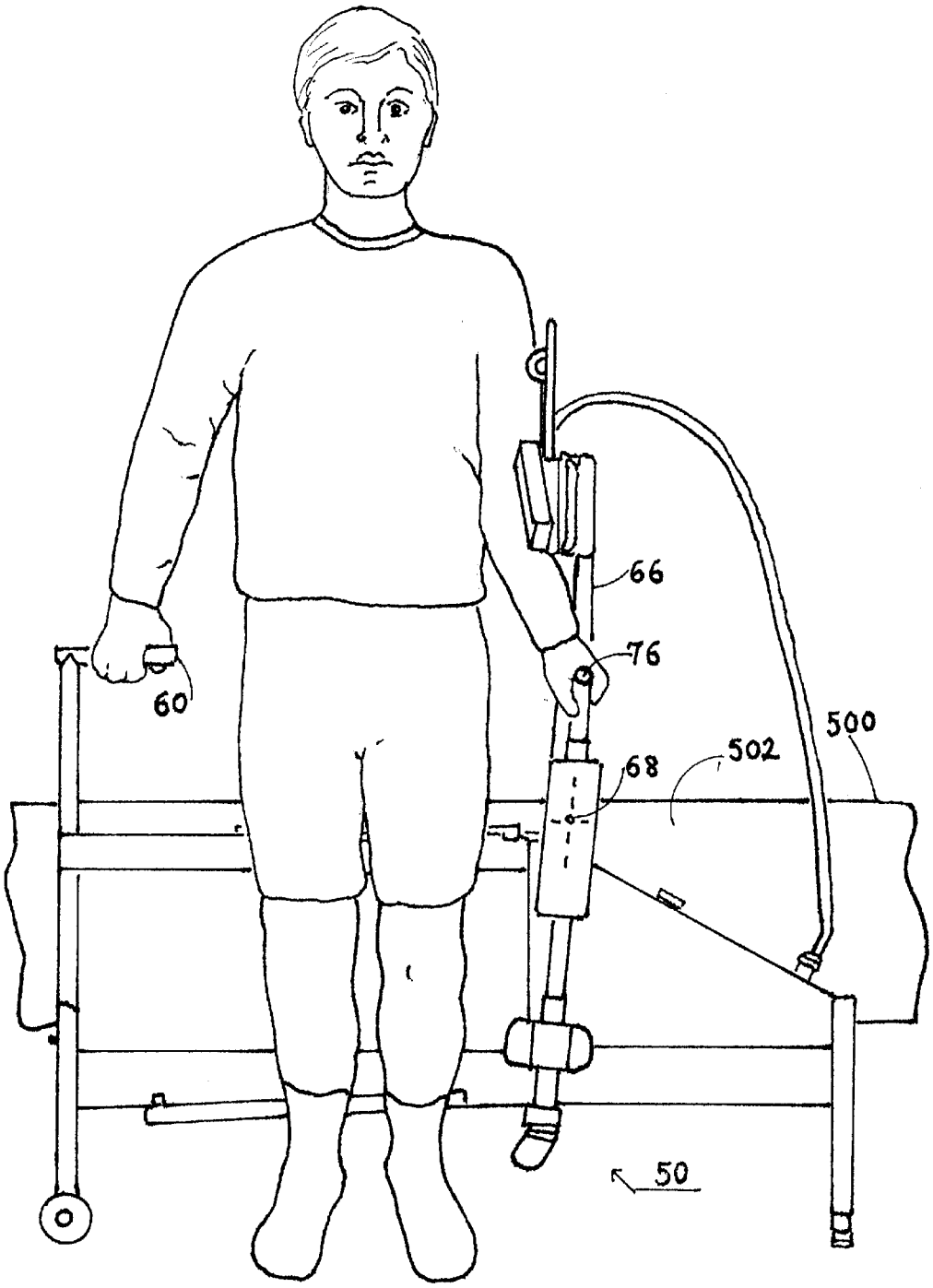
FIG. 5 is a front elevation view of the patient rotator with a person standing holding the handholds.

FIG. 5 is a front elevation view of the patient rotator 50 and bed 500 with a standing person preparing to use the apparatus. The patient has placed his right hand on the fixed handhold 60 and his left hand on the moving handhold 76. It is noted that in this figure and subsequent sequential figures, the operation of the patient rotator 50 is performed completely by the user with no assistance from another individual. The patient rotator is placed adjacent one side 502 of the bed 500 with the person support member 66 in a substantially vertial orientation and with the axis of rotation 68 substantially perpendicular to side 502.

Figure 6:
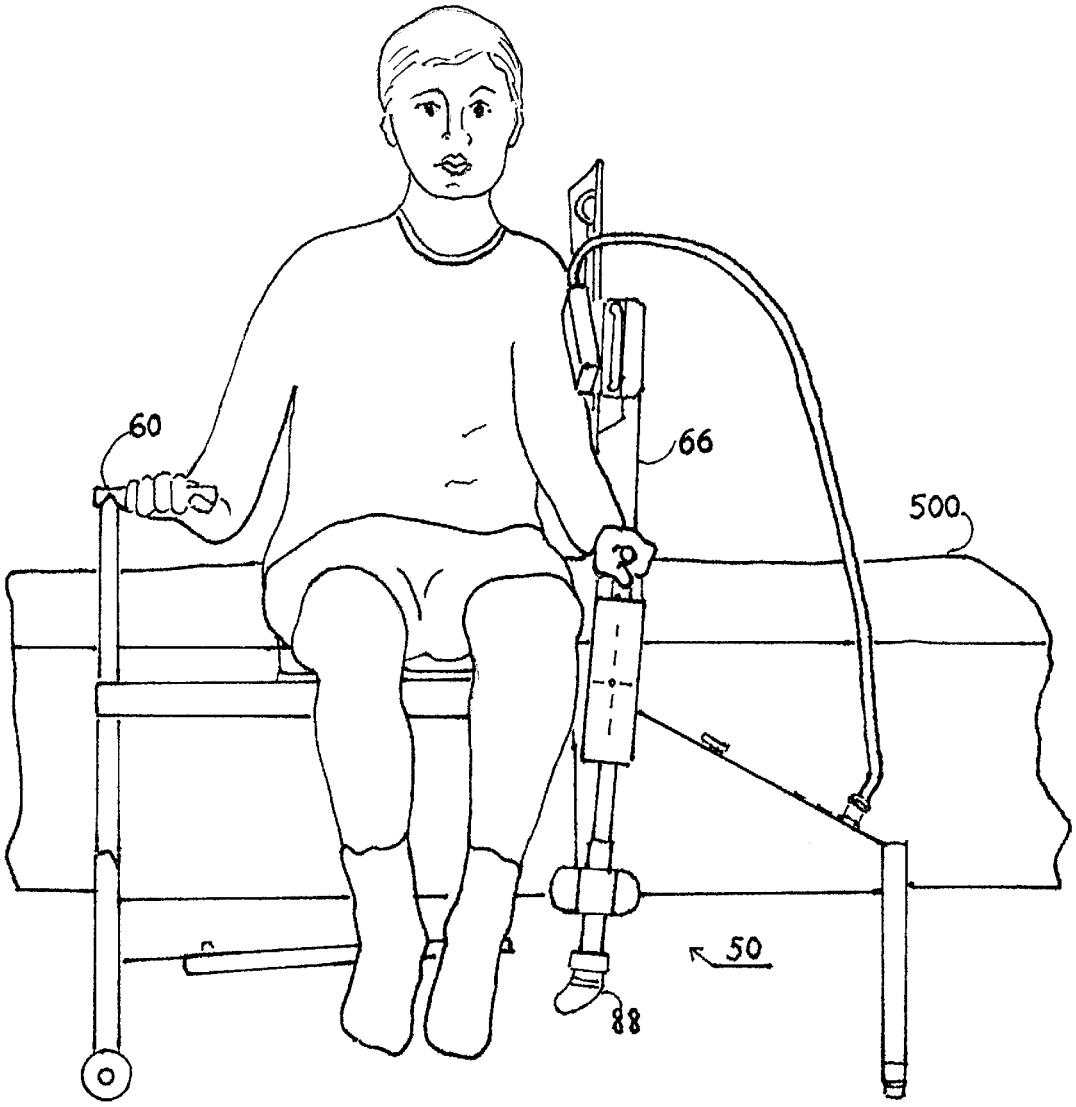
FIG. 6 is a front elevation view with the person seated holding the handholds.

FIG. 6 is a front elevation view with the person seated on the seat 58 holding the fixed handhold 60 with his right hand and the moving handhold 76 with his left hand. The handholds are close to the person's body allowing the person to place most of his upper body weight on his hands with a minimum of effort as he sits down vertically over the seat. This is important for someone with a back injury who is trying to minimize the bending, strain, and weight applied to his back as he sits down.

Figure 7:
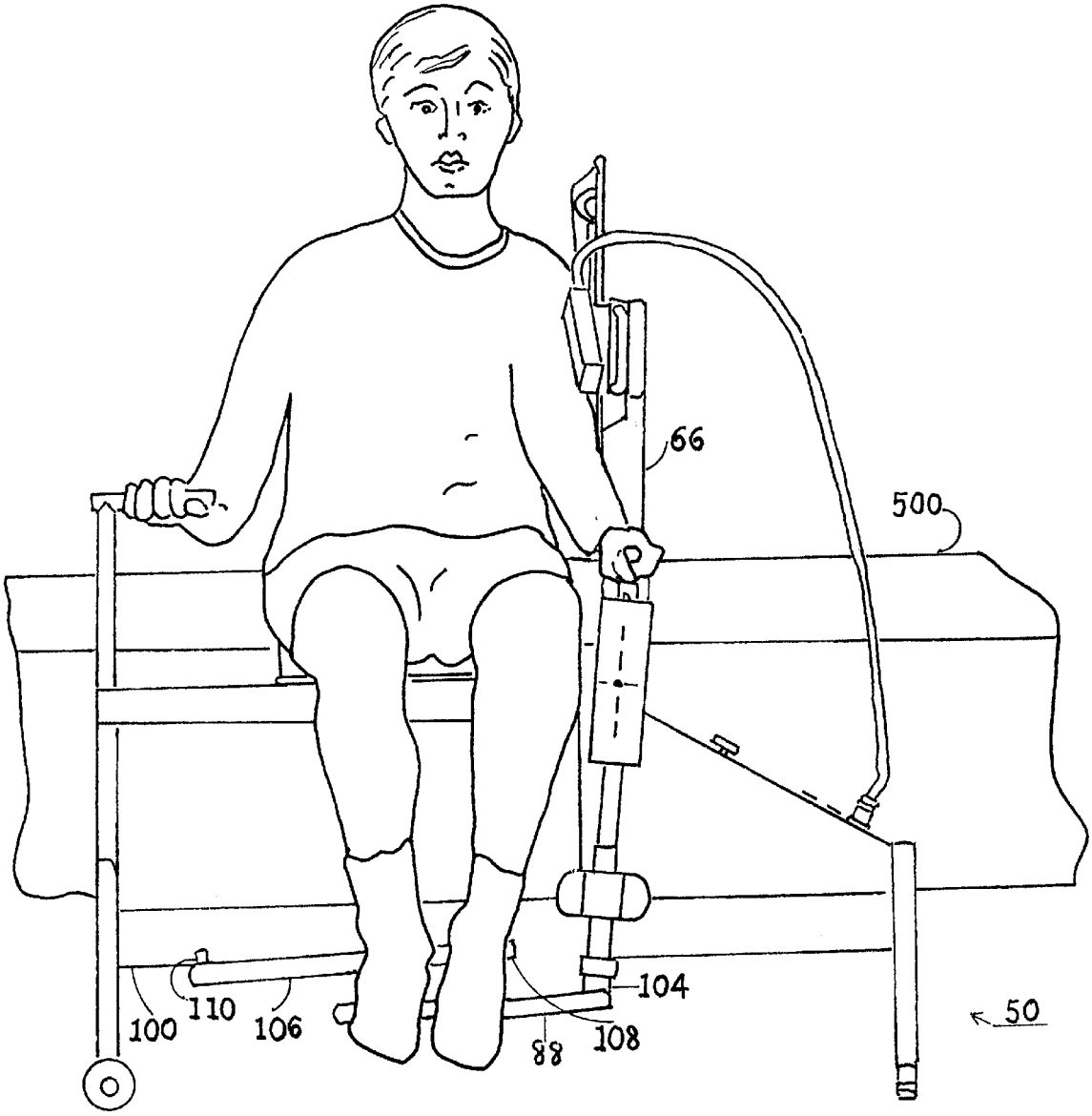
FIG. 7 is a front elevation view with the person rotating the foot support under his feet.

FIG. 7 is a front elevation view with the person rotating the foot support 88 under his feet. The foot support is on an axle 104 substantially perpendicular to the bottom of the person support member 66. A foot protector 106 mounted on a hinge 108 on seat cabinet 100 turns off the patient rotator 50 by the use of an electric switch 110 if a foot or any other object accidently gets between the foot support 88 and the seat cabinet 100 when the person support member 66 starts to turn. After his feet are in position on the foot support, the person then rests his left side adjacent the person support member in preparation for the next step.

Figure 8:
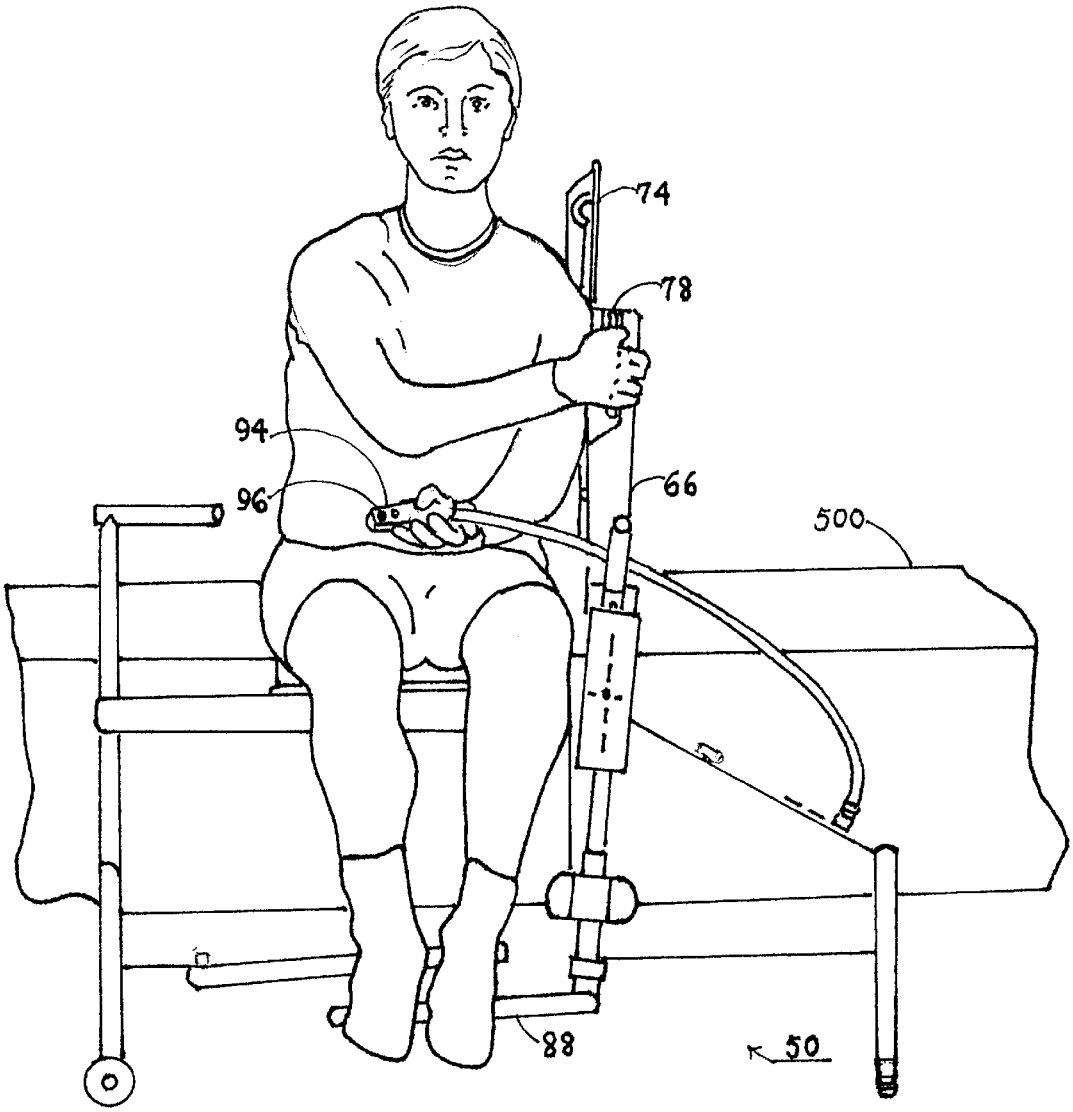
FIG. 8 is a front elevation view with the person grasping the moving handhold and drive switch.

FIG. 8 is a front elevation view with the person leaning against the torso support 74 of the person support member 66 and grasping the torso support handhold 78 and controller 94. The person activates the down position switch 96 to start the person support member moving down.

Figure 9:
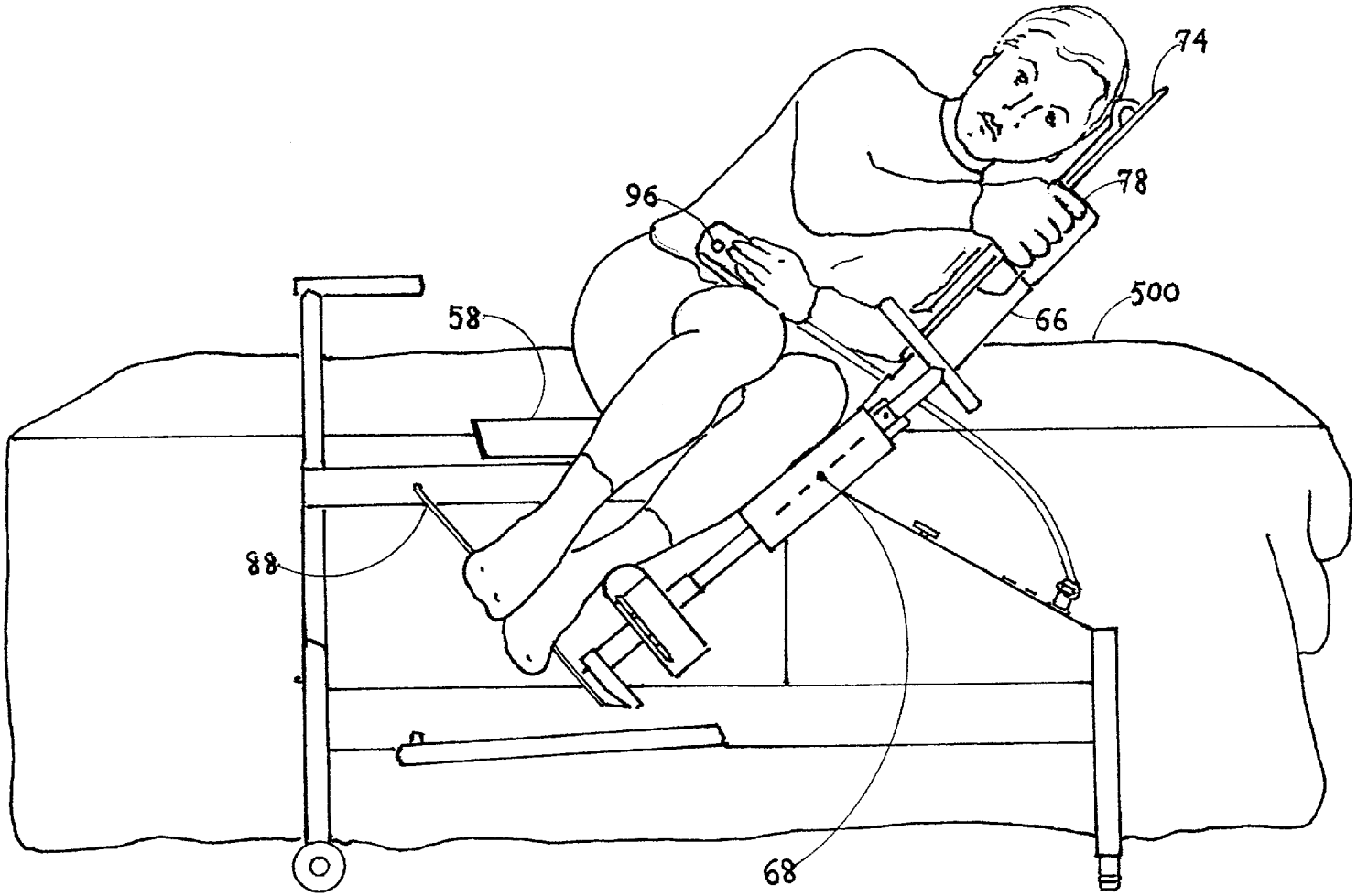
FIG. 9 is a front elevation view with the person partially rotated toward the bed.

FIG. 9 is a front elevation view with the person partially rotated toward the bed 500 on the person support member 66. Down position switch 96 is continuously depressed throughout the rotation process. The patient maintains his hand on torso support handhold 78 to better hold himself on the person support member. The sitting position is maintained as the person rotates his buttocks along the seat 58. While the seat could be attached to the person support member in order to rotate with the member, it has been found that it is not necessary in order to maintain the sitting position. In fact a seat attached to the person support member is confining and would get in the way of the movement of the legs in a later step shown in FIG. 11. The person can stop the rotation process at any time by releasing down position switch 96.

Unlike other devices which assist people in moving from one position to another, the present invention does not lift the person onto the bed. The person always maintains contact with the bed thereby giving him a sense of security and reference to the bed. This is important because the person does not experience the disorientation which usually accompanies total displacement of the body from one location to another.

Figure 10:
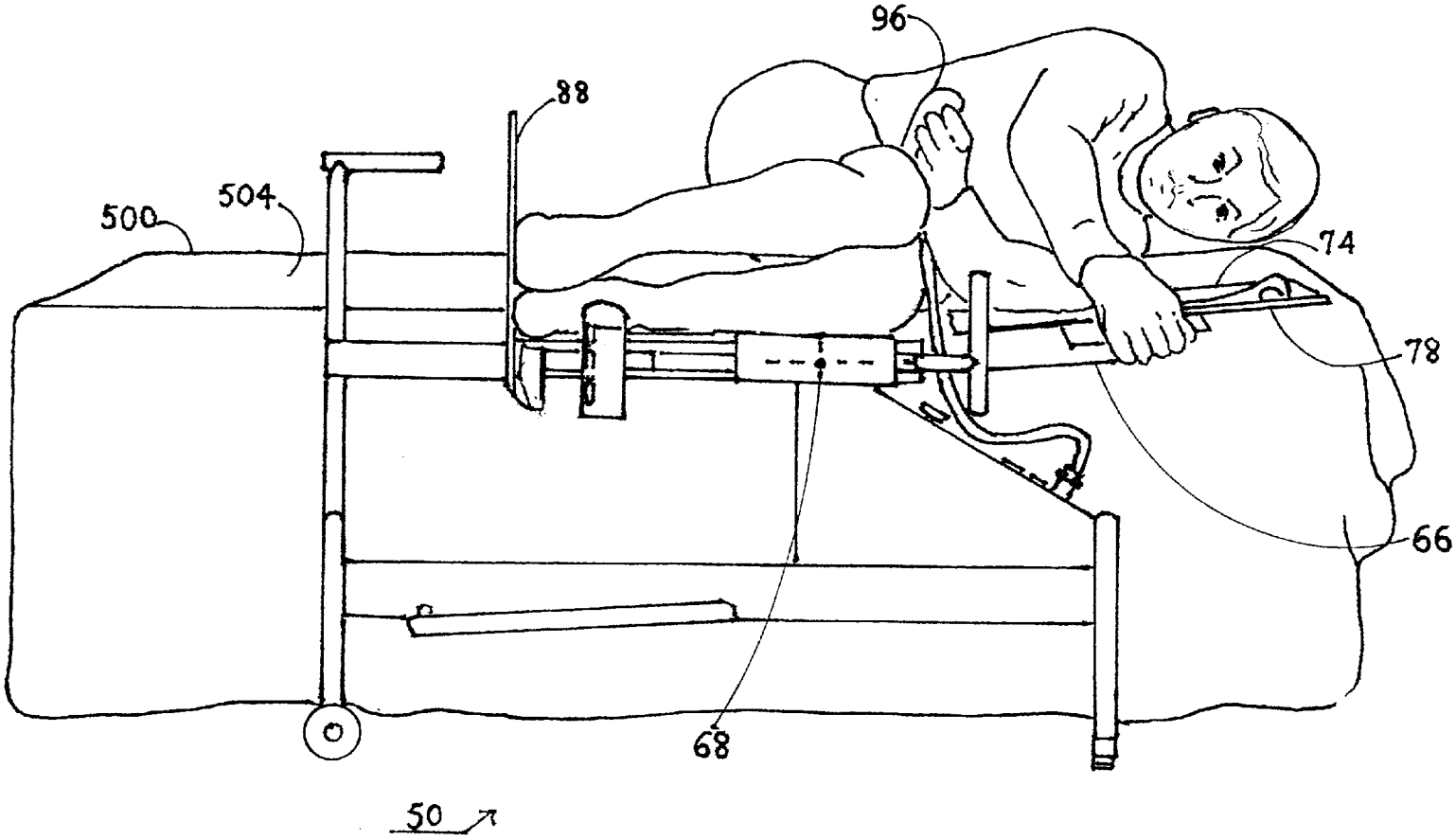
FIG. 10 is a front elevation view with the person fully rotated to horizontal.

FIG. 10 is a front elevation view with the person fully rotated to horizontal. The person is not on the top of the bed because he is still on the torso support 74. The person next moves his feet off the foot support 88 one at a time onto the bed.

Figure 11:
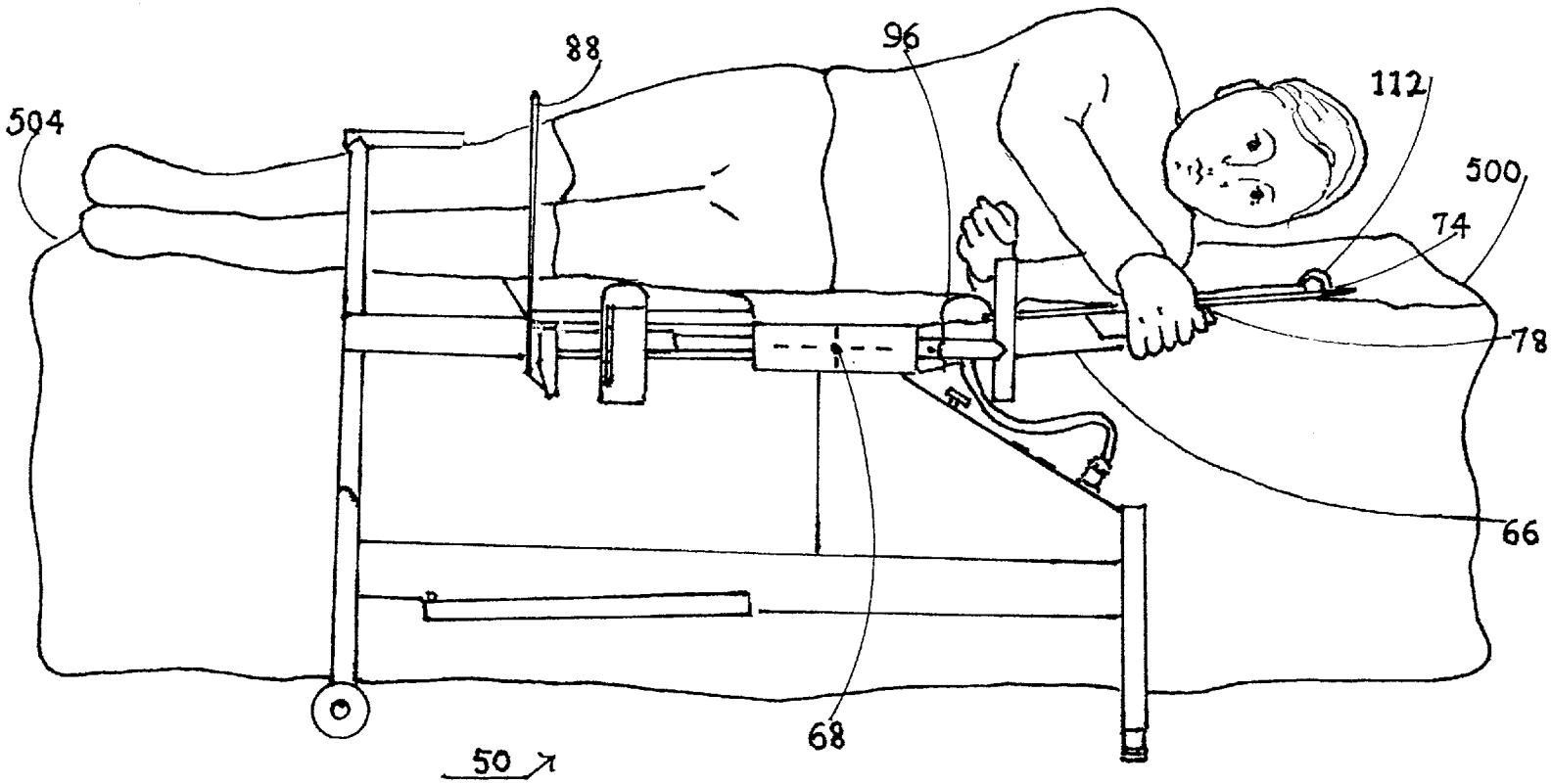
FIG. 11 is a front elevation view with the person having his legs extended.

FIG. 11 is a front elevation view with the person having his legs extended onto the bed 500.

Figure 12:
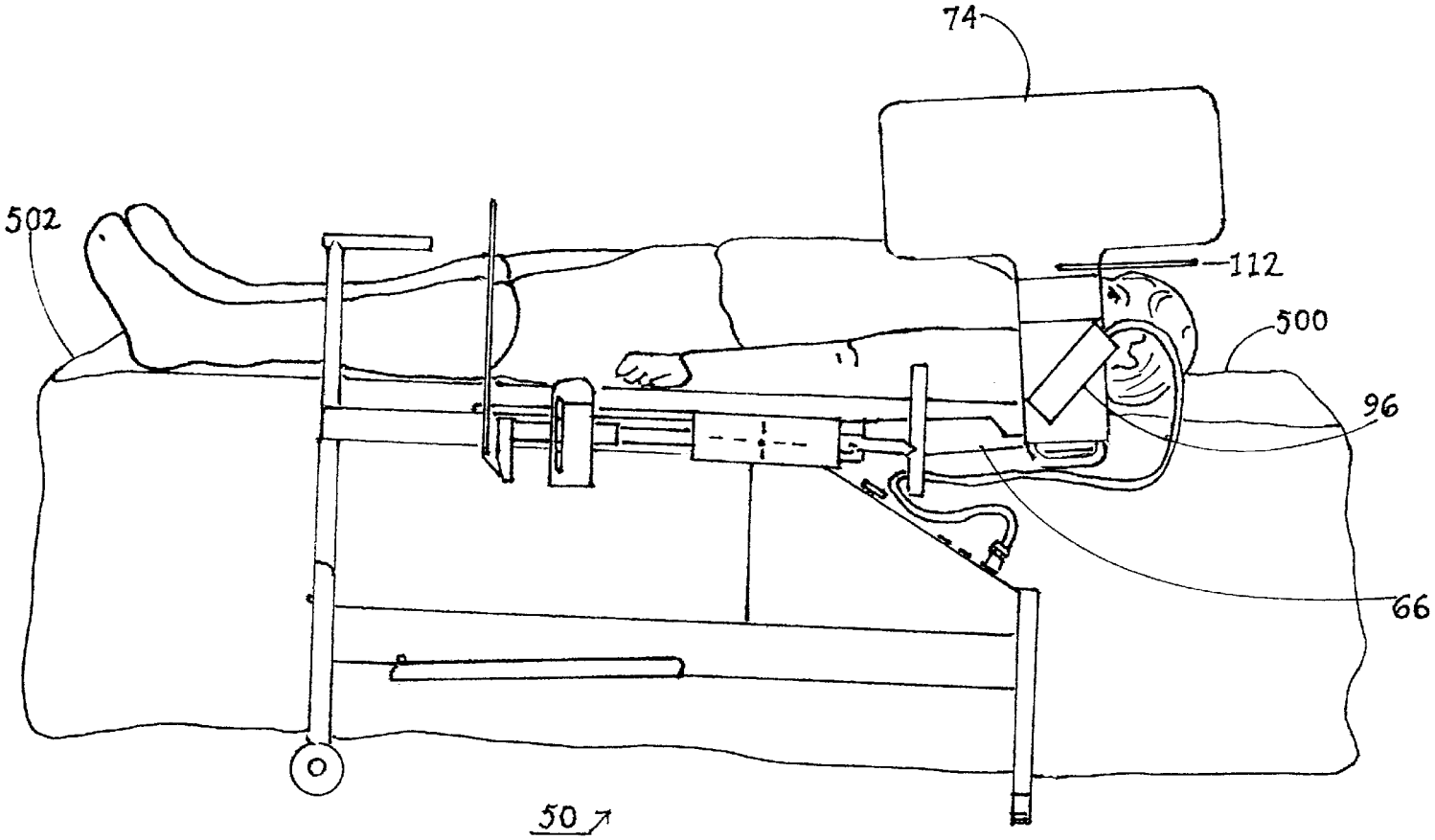
FIG. 12 is a front elevation view with the person rolled off the patient rotator and the torso support raised off the bed.

FIG. 12 is a front elevation view with the person rolled off the patient rotator 50 and the torso support 74 raised off the bed. The person then has full use of the bed without intrusion by the patient rotator 50. The entire vertical to horizontal process can be completed in less than one minute by most individuals. After the person has achieved the supine position, he can roll over to either side if that is more comfortable.

In a hospital setting after the patient has rolled off the patient rotator, it might be moved away for use by another patient. It can be then be brought back again and quickly positioned by the side of the bed when the patient is ready to get up.

An experienced user of the patient rotator will find it to be superior to even trained hospital personnel because it allows the patient to entirely control the process of getting onto a bed or other horizontal surface and then getting up. Instead of having to communicate with hospital personnel when a movement is painful with the inherent delay in making such a communication and having it understood, the patient rotator provides a known limited range of motions which are instantly controllable by the user when pain occurs or the threat of pain occurs.

Figure 13:
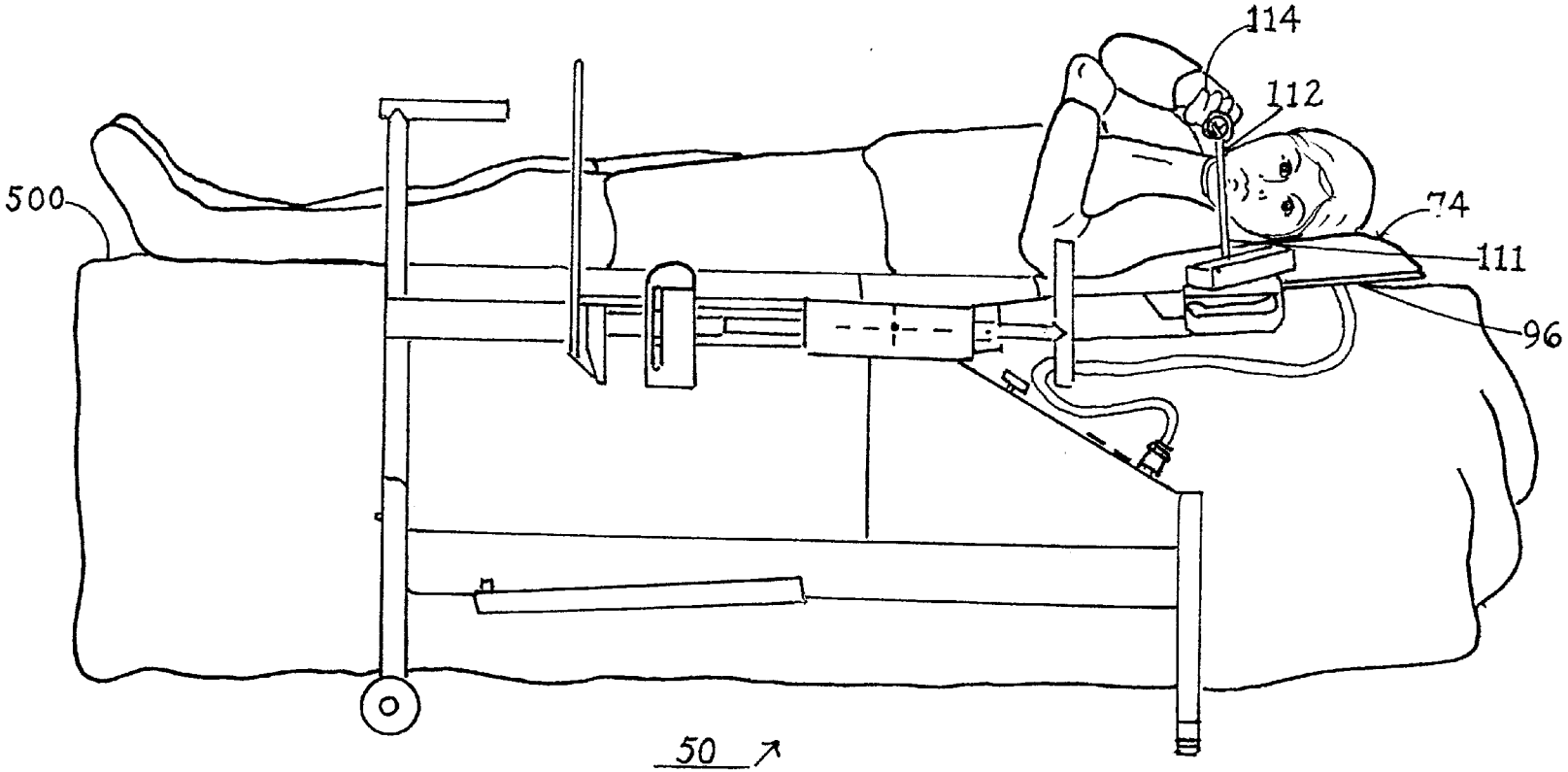
FIG. 13 is a front elevation view with the torso support returned to the bed and the person grasping the pull over strap and bar.

FIG. 13 shows the first step in the process of getting up. It is a front elevation view with the torso support 74 returned to the bed 500 from the position shown in FIG. 12. The person has lifted a pull over assembly 111 including a pull over bar 112 and strap 114. The bottom of the bar 112 is hinged to the torso support. The bar is shown in the stowed position against torso support 74 in FIGS. 5–12. The strap 114 is attached to the torso support and passes through the eye of the bar 112 to the left hand of the person. The bar facilitates the location of the strap because the person always knows where the bar is located and can find the strap where is passes through the eye of the bar.

Figure 14:
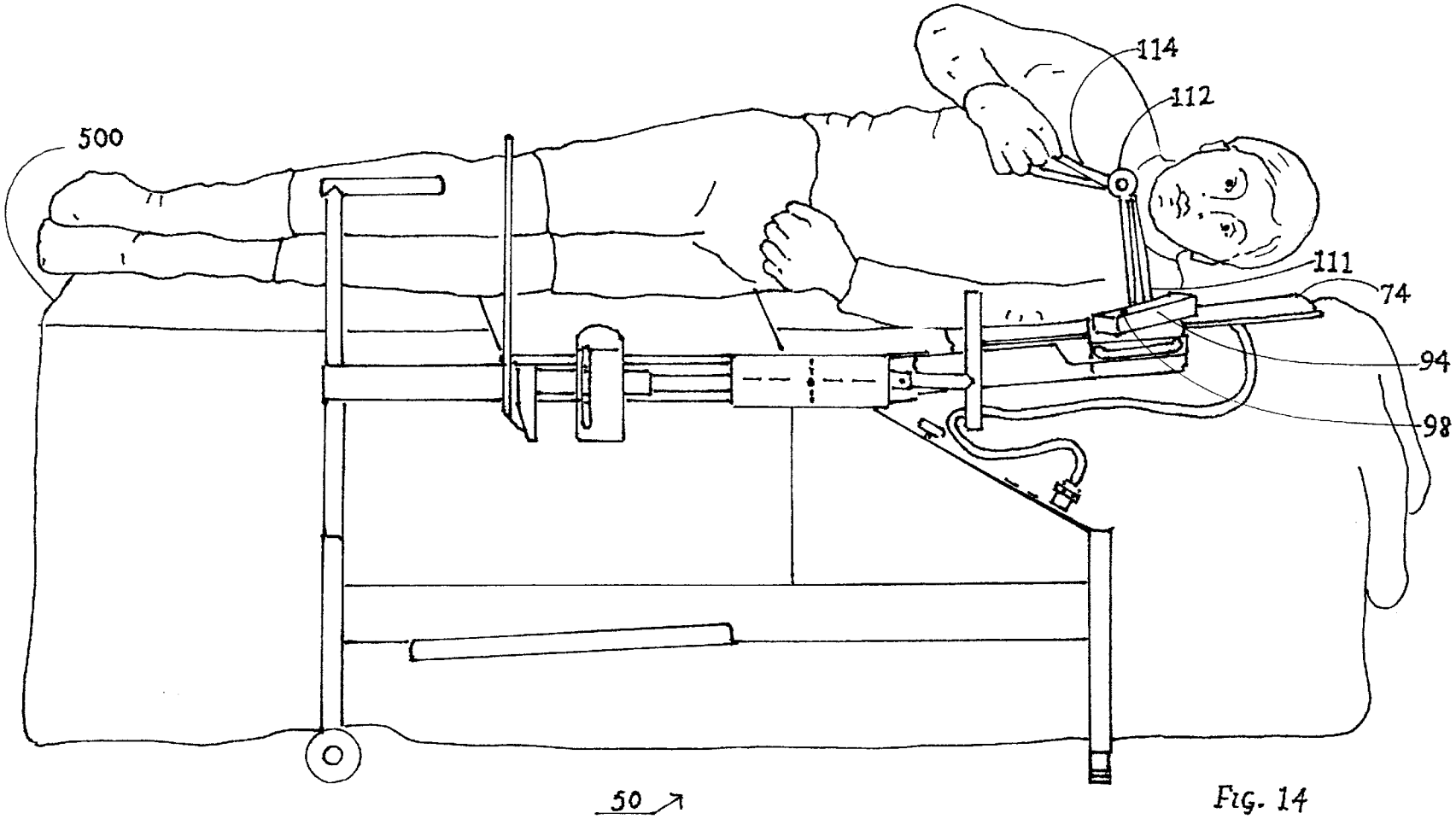
FIG. 14 is a front elevation view after the person has pulled himself over onto the torso support; and, FIG. 15 is a front elevation view with the person being pushed up by the seat elevator.

FIG. 14 is a front elevation view after the person has pulled himself over onto the torso support 74 using the pull over assembly 111. The strap 114 passes through the eye of the bar 112 and attaches to the torso support. The person then positions himself on the patient rotator 50 as shown in FIG. 10 and activates the up position switch 98 on the controller 94 rotating through the positions shown in FIGS. 9,8, and 7.

FIG. 15 is a front elevation view showing the step of getting off the bed after the person is sitting up as shown in FIG. 7. The person has swung the foot support 88 out of the way. The person uses controller 94 to activate a seat lifting means inside seat cabinet 100 causing an electric motor to push up seat 58 from the rear along the hinge 102 until the back of the seat reaches a 45° angle from horizontal. As was the case for the rotating means of the rotating member, the seat lifting means could also be hydraulic or other means. The motion pushes the person up and forward off the patient rotator 50 shifting the person's weight onto his legs. The person can use the handholds 60 and 76 to steady himself during the process until he achieves the position shown in FIG. 5.

While getting into a bed is difficult and painful, getting out of bed can be much more so. The person must use strength that is often not available and attempting this can be extremely painful. It also requires balance and coordination that is quickly lost during many illnesses or other disorders. The present invention provides an apparatus for getting up with a minimum of pain, effort, and risk. The person is in control at all times during the process of getting up and can stop instantly at any point meaning that the person's control over the situation is superior to having others help him because of his immediate ability to control his situation.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A rotator for assisting an individual having limited motion capabilities in lying down on a bed having a side and an upwardly facing horizontal surface and getting up from the horizontal surface, comprising:

a frame having a fixed seat locatable at the upwardly facing horizontal surface of the bed;

a person support member rotatably mounted on said frame having:

a head end and a foot end spaced from said head end;

a horizontal axis of rotation on said frame between said head and foot ends; and, said horizontal axis placeable substantially coplanar with the upwardly facing horizontal surface of the bed and perpendicular to the side of the bed; and, means mounted on said frame for selectively rotating said person support member about said horizontal axis of rotation between a substantially vertical orientation and a substantially horizontal orientation.

2. An individual rotator according to claim 1, said person support member further including a torso support having a flattened surface suitable for supporting the shoulder and side upper body of the individual, said flattened surface substantially coplanar with said axis.

3. An individual rotator according to claim 2, said person support member further including a torso support handhold.

4. An individual rotator according to claim 1, said person support member further including a foot support for supporting the feet of the individual mounted on said foot end perpendicular to said person support member.

5. An individual rotator according to claim 4 including a foot protector mounted on said frame adjacent said foot support by a hinge and having an electrical switch for disengaging said rotating means if an object gets between said foot support and said foot protector.

6. An individual rotator according to claim 1, said person support member further including a leg support for supporting the legs of the individual mounted between said torso support and said foot support.

7. An individual rotator according to claim 1, said frame including a fixed handhold for the individual spaced from said person support member and said person support member further including a moving handhold for the individual.

8. An individual rotator according to claim 1, said person support member further including a pull over assembly.

9. An individual rotator according to claim 1, said frame further including a seat lifting means.

10. An individual rotator according to claim 3, said person support member further including:

a foot support for supporting the feet of the individual mounted on said foot end perpendicular to said person support member;

a leg support for supporting the legs of the individual mounted between said torso support and said foot support;

a moving handhold; and, a pull over assembly; and, said frame further including:

a foot protector mounted on said frame adjacent said foot support by a hinge and having an electrical switch for disengaging said rotating means if an object gets between said foot support and said foot protector;

a fixed handhold spaced from said person support member; and, a seat lifting means.

* * * * *